US009200759B2

(12) United States Patent
Schwarz

(10) Patent No.: US 9,200,759 B2
(45) Date of Patent: Dec. 1, 2015

(54) LAMP HAVING INDIRECT LIGHT EMISSION

(75) Inventor: Bernd Schwarz, Eberbach (DE)

(73) Assignee: COOPER CROUSE-HINDS GMBH, Soest (DE)

( * ) Notice: Subject to any disclaimer, the term of this patent is extended or adjusted under 35 U.S.C. 154(b) by 34 days.

(21) Appl. No.: 14/111,762

(22) PCT Filed: Apr. 3, 2012

(86) PCT No.: PCT/EP2012/001482
§ 371 (c)(1),
(2), (4) Date: Mar. 28, 2014

(87) PCT Pub. No.: WO2012/139723
PCT Pub. Date: Oct. 18, 2012

(65) Prior Publication Data

US 2014/0226328 A1 Aug. 14, 2014

(30) Foreign Application Priority Data

Apr. 15, 2011 (DE) ..... 10 2011 017 161

(51) Int. Cl.
*F21V 1/00* (2006.01)
*F21K 99/00* (2010.01)
(Continued)

(52) U.S. Cl.
CPC . *F21K 9/30* (2013.01); *F21S 4/008* (2013.01); *F21V 7/005* (2013.01); *F21V 7/0008* (2013.01);
(Continued)

(58) Field of Classification Search
CPC ..... F21V 7/0008; F21V 7/09; F21V 17/164; F21V 7/005; F21V 29/004; F21V 29/763; F21S 4/008; F21K 9/30; F21Y 2101/02; F21Y 2103/003; F21Y 2113/00
USPC ..... 362/235, 247, 516, 517, 518, 544, 545, 362/547, 218, 219, 223, 225, 217.05, 362/217.02; 257/99, 100
See application file for complete search history.

(56) References Cited

U.S. PATENT DOCUMENTS 6,789,914 B1 * 9/2004 Brown et al. ..... 362/147
2010/0110679 A1 * 5/2010 Teng et al. ..... 362/235
(Continued)

FOREIGN PATENT DOCUMENTS

CN 101936469 10/2014
DE 20 2011 003 261 6/2011
(Continued)

OTHER PUBLICATIONS

Victor Lighting Catalog, Jul. 2009.*
(Continued)

*Primary Examiner* — Anh Mai
*Assistant Examiner* — Glenn Zimmerman
(74) *Attorney, Agent, or Firm* — King & Spalding LLP

(57) ABSTRACT

A lamp has a plurality of LEDs which are arranged behind one another in the lamp's longitudinal direction and in LED spacing by means of an LED carrier. Each LED emits light in a certain solid angle area around a beam center direction. The solid angle area is directed towards a lamp reflector for indirect light emission of the lamp. The number of LEDs and/or the LED spacing is selected in such a way that the solid angle areas of all LEDs after reflection at the light reflector overlap at least partially at an illumination surface distance from an underside of the lamp of at least 0.2 to 2.5 times the distance between the LEDs that are spaced the farthest apart from each other.

14 Claims, 3 Drawing Sheets

(51) Int. Cl.

| | |
|---|---|
| ***F21V 7/00*** | (2006.01) |
| ***F21S 4/00*** | (2006.01) |
| ***F21V 7/09*** | (2006.01) |
| ***F21V 17/16*** | (2006.01) |
| *F21Y 101/02* | (2006.01) |
| *F21Y 103/00* | (2006.01) |
| *F21V 29/00* | (2015.01) |
| *F21Y 113/00* | (2006.01) |
| *F21V 29/76* | (2015.01) |

(52) U.S. Cl.

CPC ..... *F21V 7/09* (2013.01); *F21V 17/164* (2013.01); *F21V 29/004* (2013.01); *F21V 29/763* (2015.01); *F21Y 2101/02* (2013.01); *F21Y 2103/003* (2013.01); *F21Y 2113/00* (2013.01)

(56) References Cited

U.S. PATENT DOCUMENTS

| | | | | |
|---|---|---|---|---|
| 2010/0182782 | A1* | 7/2010 | Ladewig ..... | 362/235 |
| 2010/0327768 | A1* | 12/2010 | Kong et al. ..... | 315/294 |
| 2011/0261565 | A1* | 10/2011 | Gerli et al. ..... | 362/235 |

FOREIGN PATENT DOCUMENTS

| | | | |
|---|---|---|---|
| EP | 2270390 | | 1/2011 |
| JP | 200392006 | | 3/2003 |
| JP | 2007300138 | | 11/2007 |
| JP | 2008287994 | | 11/2008 |
| JP | 2011-9223 | | 1/2011 |
| KR | 10-0731454 | | 6/2007 |
| WO | 2010 070565 | | 6/2010 |
| WO | WO 2010070565 | A1 * | 6/2010 |
| WO | 2011 019753 | | 2/2011 |

OTHER PUBLICATIONS

The Korean Intellectual Property Office, The Examination Bureau, Office Action issued in Korean Application No. 10-2013-7028890, May 30, 2014, 5 pages, translation 4 pages.

The State Intellectual Property Office of the People's Republic of China, Office Action issued in Patent Application No. 201280026952.X, Aug. 26, 2014, 14 pages total with translation of office action.

Japanese Patent Office, Examiner Nakamura, Norio, 2nd Examination Department, Living Appliance Division, Office Action issued in Patent Application No. 2014-504198, mailing date Aug. 12, 2014, 13 pages total with translation of office action.

* cited by examiner

LAMP HAVING INDIRECT LIGHT EMISSION

RELATED APPLICATIONS

This application is a Section 371 national phase application of and claims priority to PCT application PCT/EP2012/001482 filed on Apr. 3, 2012, which claims priority to German Patent Application Number 10 2011 017 161.4 filed on Apr. 15, 2011, the contents of which are incorporated herein in their entirety.

BACKGROUND

The introduction of light emitting diodes as light sources results in the possibility of replacing a number of otherwise customary light sources with such LEDs. However LEDs are characterized by specific features that hinder a further use of such light sources.

For example, LEDs are punctiform light sources that are also perceived as such by an observer. Even when a multiplicity of such light sources are used, the result, particularly in the case of direct illumination, is a corresponding multiplicity of punctiform light sources, and the use of this multiplicity of LEDs can result in corresponding shadows that overall hinder the lighting by means of these light sources.

An LED is furthermore a very intense light source that easily leads to glare and possibly even to an unhealthy influencing of the eye of an observer.

These disadvantages become all the more apparent if a plurality or multiplicity of such LEDs are provided in a linear arrangement.

In the case of such light sources, it must furthermore be observed that the generated heat cannot be disregarded and separate measures may possibly have to be taken for cooling and the like.

SUMMARY

The basis of the invention is formed by the object of providing a lamp with LEDs in which a multiplicity of such illuminants can be used in a simple manner and without the aforementioned disadvantages or that greatly reduces these in order, for example, to replace fluorescent lamps or the like as customary illuminants.

According to the invention, a corresponding plurality of LEDs are arranged in the lamp's longitudinal direction, one behind the other and with LED spacing, by means of an LED carrier. Each LED emits light in a certain solid angle area around a beam centre direction. Each solid angle area of an LED is directed toward a lamp reflector for indirect light emission of the lamp. The number of LEDs and/or the LED spacing is selected in such a way that the solid angle areas of all LEDs after reflection at the lamp reflector overlap at least partially at an illumination surface distance from an underside of the lamp that is at least 0.2 to 2.5 times the distance between the LEDs that are spaced the farthest apart from each other.

According to the invention, the LEDs are consequently all arranged one behind the other along the lamp's longitudinal direction and the emitted light is emitted by the lamp only after a corresponding reflection at the lamp reflector. At the same time, the reflection occurs in the manner that the corresponding solid angle areas of all LEDS overlap at least partially, whereby a corresponding overlap also occurs correspondingly with the LEDs that are spaced the farthest apart from each other. In order to guarantee that such an overlap takes place for corresponding observers at a corresponding distance to the lamp, the at least partial overlapping already occurs starting at a distance of at least 0.2 to 2.5 times the distance between the LEDs that are spaced the farthest apart from each other. This means that in the case of a maximal spacing of the LEDs within the lamp of, for example, a meter, the solid angle areas of the LEDs that are spaced the farthest apart from each other already correspondingly overlap in 20 cm or at least at a distance of 2.5 meters from the lamp underside.

In this way the LEDs are not still perceived as individual punctiform light sources. The intensity of the LEDs is furthermore correspondingly weakened or at least distributed across a larger area due to the corresponding reflection and distribution of their light emission, so that no damaging effects can occur for the eyes of an observer. The corresponding light distribution and indirect emission of the light take place by means of the lamp reflector.

The overall result is consequently a relatively homogenous light source in spite of the plurality of individual LEDs used. At the same time, corresponding shadow formations are prevented and glare as a result of the LEDs is avoided.

As a rule, a solid angle area in which an LED lights amounts to 90° to 140° depending on the LED type.

At the same time, according to the invention the LEDs can be arranged in part closer with respect to one another or also in smaller groups due to the avoidance of glare.

For corresponding distribution of the light emission of each LED and for overlapping of the different solid angle areas, it is sufficient if the lamp reflector runs linearly in the lamp's longitudinal direction. I.e., where appropriate, except for end sections of the lamp reflector, the lamp reflector extends linearly without curvatures in the lamp's longitudinal direction.

In order to be able to influence the light distribution in the direction transverse to the lamp in a certain manner, the lamp reflector can be put together from a number of essentially flat or curved reflector surfaces in the direction transverse to the lamp. Depending on the arrangement of these reflector surfaces, the result is a corresponding light distribution in the direction transverse to the lamp that likewise can recreate a fluorescent lamp or the like with respect to the emission.

In a simple embodiment, all reflector surfaces are connected to one another so that essentially a one-piece lamp reflector is used.

The different reflector surfaces can be tilted relative to one another in order to establish an illumination angle common to all LEDs. For example, an appropriate illumination angle can amount to 30°, 40° or also 45° at least along a line of arranged LEDs. Other illumination angles are likewise possible.

In the case of the lamp according to the invention, it is likewise conceivable that two or also more groups of LEDs are arranged next to one another in the direction transverse to the lamp. This corresponds, for example, to an arrangement of two or more fluorescent lamps. It is also possible with respect to these groups of LEDs to establish a certain illumination angle for each group by arranging the reflector surfaces. The illumination angle of each group of LEDs can thereby be different.

It is furthermore conceivable that the illumination angles of the LED groups overlap each other and establish a certain illumination angle overall.

It can be advantageous for the arrangement of the LED groups if an LED carrier is assigned to each LED group. In this way, the LED groups can be handled and also exchanged separately.

Depending on the arrangement of the LED groups, it is likewise conceivable that only one LED carrier is provided for both LED groups.

As a rule, the corresponding LED carrier is also used as a cooling device for the LEDs. In this connection, it can be advantageous if the lamp carrier has cooling fins. The LED carrier can also be formed without cooling surfaces and, for example, can be mounted directly on the lamp housing or it can be a part of the same.

Particularly in the case of an arrangement of two LED groups, the configuration of the lamp reflector can be simplified by means of arranging the reflection surfaces for each LED group as the mirror image with respect to one another. An asymmetric arrangement is also conceivable in order to concentrate the light in certain areas, for example, by means of corresponding reflection.

This can be accomplished by forming all reflection surfaces for all LED groups from only one lamp reflector.

For simple handling and mounting of the lamp, it can have a lamp housing with a transparent or translucent housing section at least in the light emission direction. It is likewise conceivable that the lamp housing is open in the light emission direction.

The lamp reflector can, for example, be held within the lamp housing in a detachable manner. The corresponding holding can be brought about by means of screwing or the like. It is likewise conceivable that the lamp reflector is latched into place in the light housing on lateral end sections so that no further measures have to be taken for the attachment. The lamp reflector can also form a unit that is firmly attached to the light housing.

It is likewise possible that the LEDs of each LED group form two essentially separated illumination areas. A certain overlap can take place between these illumination areas, whereby, however, each LED group essentially lights in parallel directions and with solid angle areas that are separated from one another. An overlap of the solid angle areas or illumination areas can occur only at a certain distance to the lamp, whereby this overlap increases, i.e., the illumination areas intermix more and more, as the distance to the lamp increases.

In order that the lamp can also be used in potentially explosive areas, the LEDs can be formed with a corresponding type of ignition protection such as Ex-d or Ex-m, for example.

This can be brought about by casting the LEDs with the assigned cooling surfaces or heat sinks. The LEDs can be formed by an LED strip with a corresponding number of LEDs. This strip is laid on to the cooling surface and is covered with a cover for all LEDs of the corresponding strip. This cover can then be cast along its entire circumference by a corresponding casting compound relative to the holder of the LEDs so that a corresponding type of ignition protection is realised.

The arrangement of the corresponding LED carriers can preferably be brought about in such a manner that these are arranged outside the reflected solid angle area of each LED.

BRIEF DESCRIPTION OF THE DRAWINGS

In the following, advantageous embodiments of the invention are explained in more detail using the figures represented in the enclosed drawings.

Shown are.

DETAILED DESCRIPTION OF THE EXAMPLE EMBODIMENTS

Figure 1:
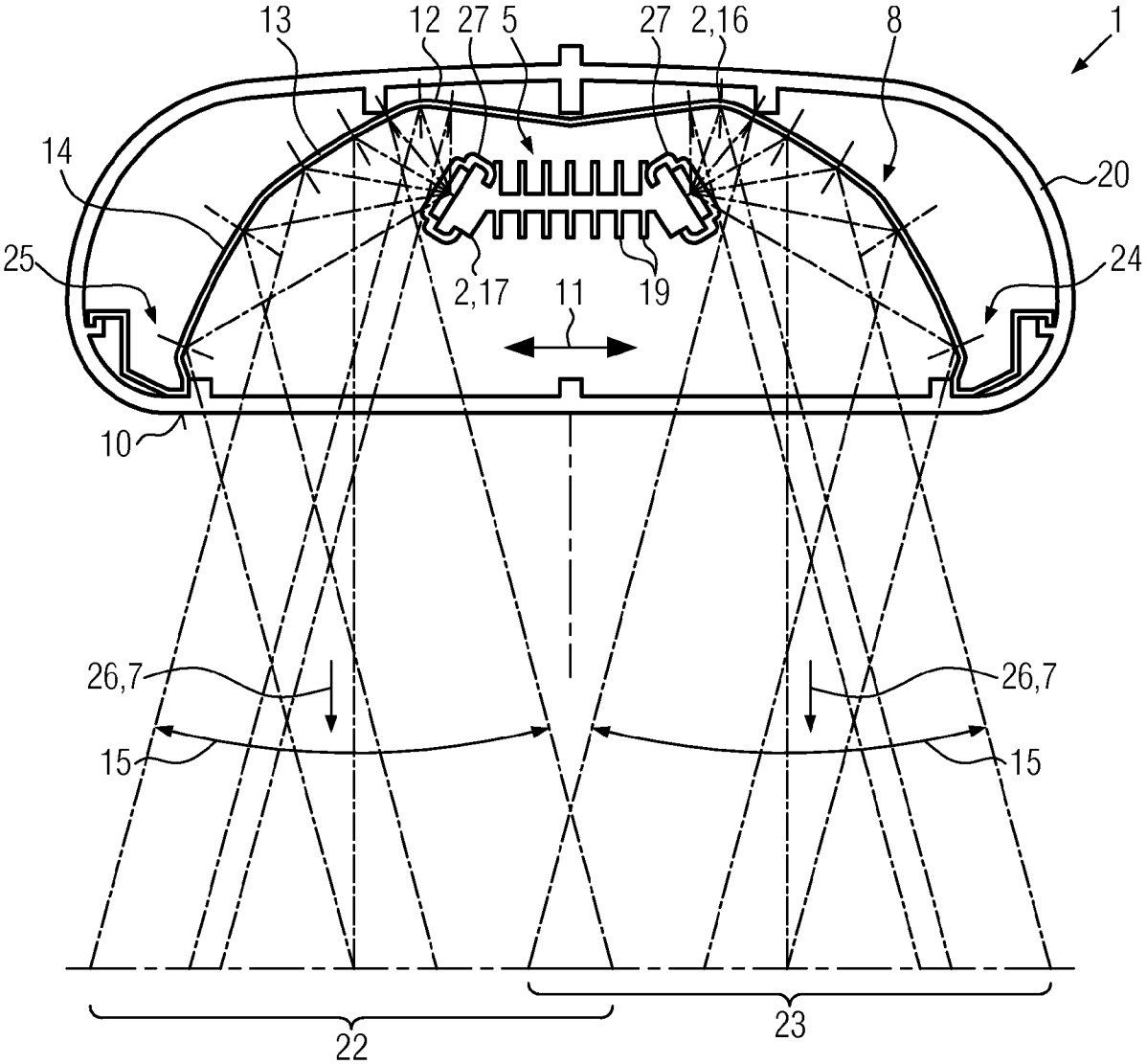
FIG. 1 a cross-section through a first embodiment of a lamp according to the invention.

FIG. 1 shows a cross-section, see the direction transverse to the lamp 11, through a first embodiment of a lamp 1 according to the invention. This has two groups of LEDs 2, see LED groups 16 and 17. Both LED groups 16 and 17 are arranged on an LED carrier 5. At the same time, this forms a heat sink with corresponding cooling fins 19. The LED groups 16, 17 are arranged on the associated carrier with certain LED spacing 4, also see FIG. 3. All LEDs 2 are arranged on an LED strip that lies on a corresponding cooling surface of the LED carrier 5. The LEDs 2 are covered by a cover housing 27 that is, for example, cast with the carrier 5 in order that the LEDs are formed with an appropriate type of ignition protection such as Ex-d or Ex-m.

In the depicted embodiment, the LEDs 2 of the corresponding groups 16 and 17 are arranged such that they tilt outward. Each LED emits light in a certain solid angle area 6, which is marked in FIG. 1 by the different beams emanating from the LEDs 2. The entire solid angle area 6 strikes different flat reflector surfaces 12, 13, 14, which altogether form a light reflector 8. In this way, light is emitted by the lamp indirectly in the solid angle area 6, also see the corresponding solid angle areas below the lamp 1 that have corresponding illumination angles 15. The accompanying light emission direction 26 is directed away from the lamp 1 and toward an observer. Each of the solid angle areas 6 has a beam centre direction 7 around which the solid angle area 6 extends, also see the following figures.

The lamp reflector 8 is formed in a single piece from a line of corresponding reflector surfaces 12, 13 and 14. The reflector surfaces are thereby arranged symmetrically to a centre axis of the lamp 1 so that equal parts of the light reflector are assigned to each LED group 16 or 17.

On the basis of the arrangement of the corresponding reflector surfaces, two solid angle areas 6 essentially result, whereby each solid angle area is assigned to a group 16, 17, also see the illumination areas 22 and 23 and the associated illumination angle 15, each of which is arranged around a corresponding beam centre direction 7.

The two solid angle areas 6 overlap each other at least in adjacent areas of the illumination areas 22 and 23.

The lamp reflector 8 is arranged within a corresponding lamp housing 20. The lamp reflector 8 is latched into place within the lamp housing 20 on its end sections 24 and 25.

Figure 2:
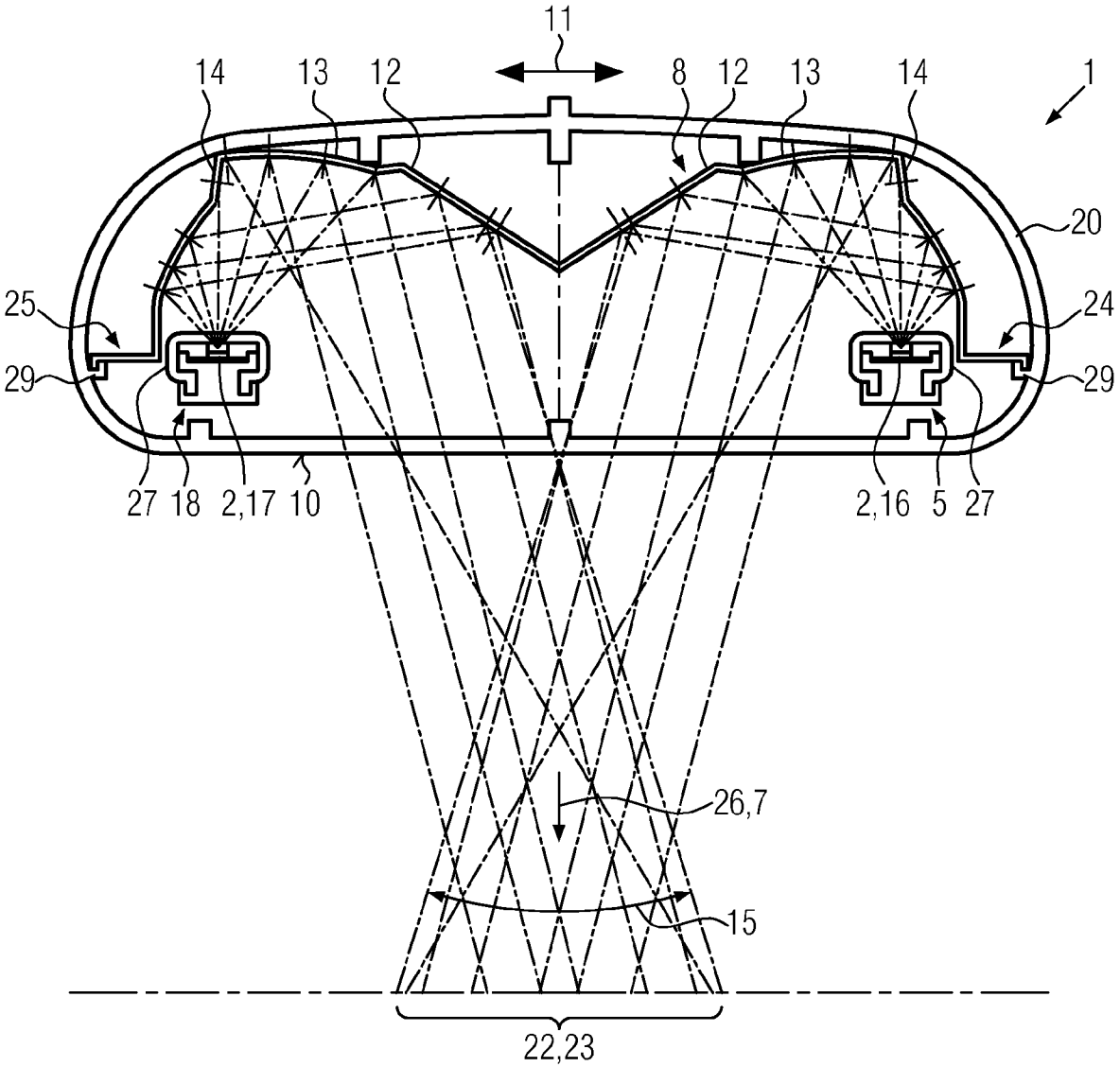
FIG. 2 a cross-section through a second embodiment of a lamp according to the invention.

FIG. 2 shows a sectional view similar to FIG. 1 through a second embodiment of a lamp 1 according to the invention. In this lamp, the LEDs 2 are arranged within the corresponding lamp housing 20 separated from one another as LED groups 16 and 17 on lateral ends. Each LED group 16 or 17 has a carrier 5 or 18 that can be constructed in a manner similar to that for the carrier as shown in FIG. 1. Each of these carriers comprises at least a heat sink and a cover housing 27 for the LEDs 2 arranged one behind the other in a line in the lamp's longitudinal direction.

The shape of the lamp housing 20 as shown in FIG. 2 corresponds to that as shown in FIG. 1. The lamp reflector 8 has a somewhat different shape, however. It is made up of corresponding reflector surfaces 12, 13, 14 and the like, whereby these reflect light emitted by the LEDs 2 in such a way, however, that the corresponding solid angle areas 6 overlap one another in the illumination areas 22 and 23. The illumination angle 15 thereby essentially corresponds to the illumination angle 15 of FIG. 1 and amounts, for example, to roughly 30°.

In the embodiment according to FIG. 2, end sections 24 and 25 of the lamp reflector 8 are also attached within the lamp housing 20 in a detachable manner by means of being latched into place. The same latching elements are thereby used in the interior of the lamp housing 20, see particularly the inwardly projecting engagement hooks 29. In the embodiment as shown in FIG. 2, the corresponding LEDs 2 are also formed with the Ex-d or Ex-m type of ignition protection.

Apart from that, the same parts are identified with the same reference numbers in all figures and are in some cases described in more detail only in connection with one figure.

Figure 3:
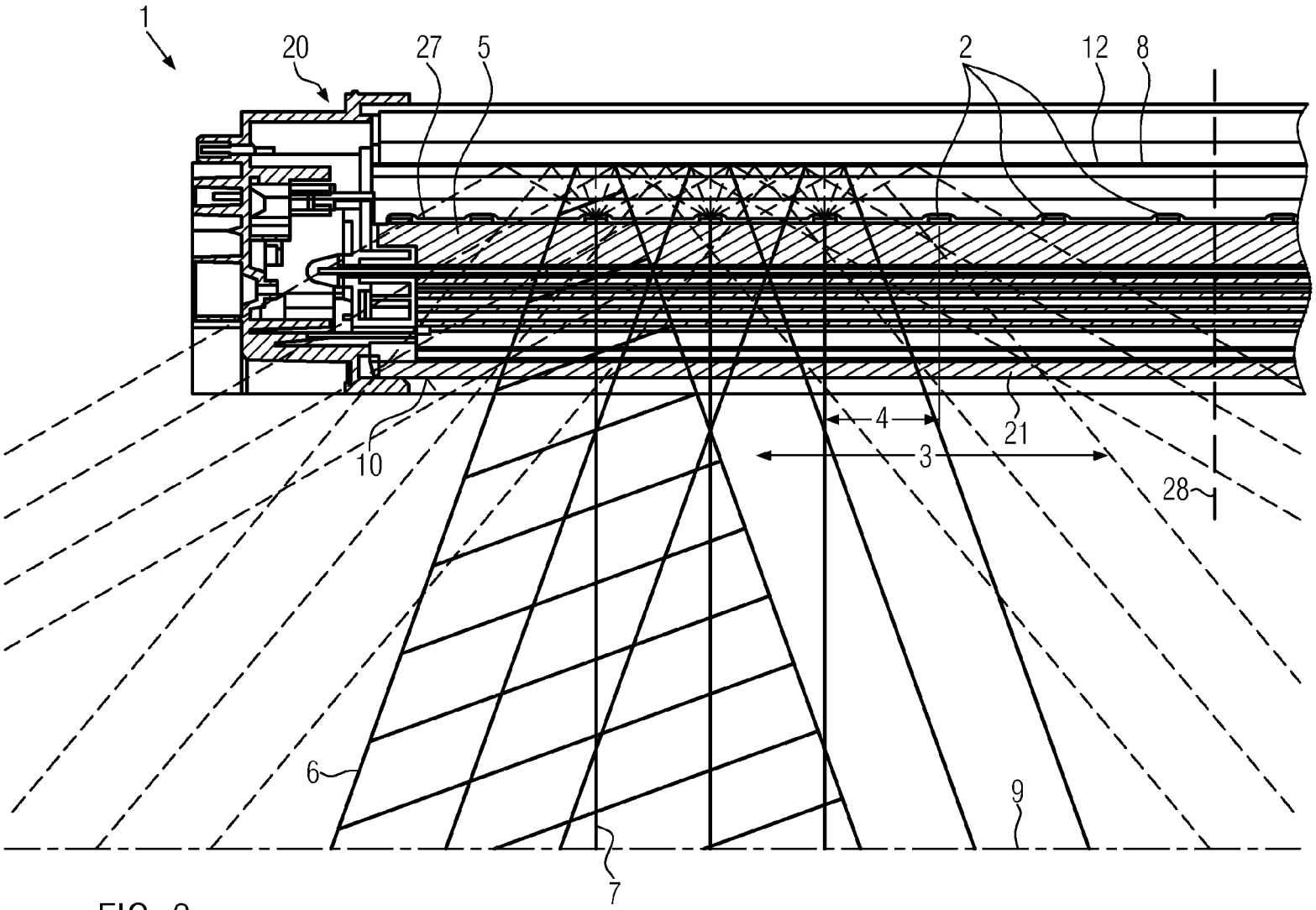
FIG. 3 a partial longitudinal section through the lamp of FIG. 2 in the area of an LED group.

FIG. 3 shows a partial representation of a longitudinal section through a lamp 1 according to FIG. 2, whereby the longitudinal section runs exactly along the LEDs 2 of an LED carrier 5 or 18, whereby these LEDs 2 are arranged linearly one behind the other. Half of the lamp 1 is shown in FIG. 3, see corresponding centre axis 28, whereby the parts of the lamp that are discussed here are arranged in the same manner in both halves of the lamp.

The different LEDs 2 are arranged in the lamp's longitudinal direction 3 with corresponding LED spacing 4 on the associated LED carrier 5. In particular, FIG. 3 shows how the different solid angle areas 6 of the LEDs 2 that are arranged one behind the other overlap one another after being reflected at the lamp reflector 8, see the different reflection each at an angle of 20° toward the beam centre direction 7 or also the further reflections, each at 60° or 40° relative to this beam centre direction 7. The corresponding angle of 120° of the solid angle area 6 corresponds to the maximum beam angle of the LEDs 2 used here. The LED spacing 4 and the corresponding number of LEDs 2 in the lamp's longitudinal direction 3 are selected in such a way that the reflected solid angle areas 6 of the LEDs 2 that are spaced the farthest apart from each other overlap at least partially at a corresponding illumination area distance 9, whereby this illumination surface distance 9 corresponds to at least 0.2 to 2.5 times the corresponding distance between the LEDs 2 that are spaced the farthest apart from each other. The illumination surface distance 9 is measured from an underside 10 of the lamp 1 that essentially corresponds to the underside of a transparent or translucent housing section 21. The distance between the LEDs 2 that are spaced the farthest apart from each other as shown in FIG. 3 corresponds to the distance between the LED 2 arranged all the way to the left in FIG. 3 and the LED 2 arranged all the way to the right in the half that is not shown.

Several solid angle areas 6 of adjacent LEDs 2 are shown in FIG. 3 for an aperture angle of 20° of the corresponding areas around the beam centre direction 7. These also already overlap, which applies in a similar way in the case of larger angles to the corresponding solid angle areas with respect to LEDs 2 that are spaced farther apart from each other.

Due to the corresponding overlap of the different solid angle areas 6 and due to the reflection of the light emitted by the LEDs 2 at the corresponding lamp reflector 8, there results a homogenous distribution of the light emission so that punctiform light sources can no longer be discerned at the corresponding illumination surface distance 9. Glare due to the different LEDs 2 likewise no longer occurs thanks to this homogenous distribution of light. Instead, the illumination pattern of the LEDs essentially corresponds to that of a fluorescent lamp or also two fluorescent lamps arranged next to one another, see FIG. 1, for example.

Due to the use of a corresponding carrier with corresponding cooling effect for the LEDs, further cooling is not required and the LEDs can be arranged at relatively small distances from one another. As a result, when a corresponding cover housing 27 is used for the LEDs 2, a small free volume results, which is advantageous for the corresponding explosion protection or for forming the LEDs with the corresponding type of ignition protection.

The invention claimed is:

1. A lamp comprising LEDs arranged one behind the other in a longitudinal direction of the lamp and each LED in LED spacing by means of an LED carrier, wherein each LED emits light in a respective solid angle area around a respective beam center direction, wherein the solid angle area is directed toward a lamp reflector for indirect light emission of the lamp, wherein a number of the LEDs and/or the LED spacing is selected such that the solid angle areas of all the LEDs overlap at least partially after reflection at the lamp reflector at an illumination surface distance from an underside of the lamp of 0.2 to 2.5 times a distance between two of the LEDs that are spaced the farthest from each other, wherein the lamp reflector runs in a straight line in the longitudinal direction of the lamp, wherein the lamp reflector is put together in a direction transverse to the lamp from a number of essentially flat or curved reflector surfaces, wherein the reflector surfaces are connected to one another, wherein the reflector surfaces are tilted relative to one another for establishing an illumination angle common to all of the LEDs, and wherein the LED carrier is arranged outside the reflected solid angle area of each LED.

2. The lamp according to claim 1, wherein two LED groups of the LEDs are arranged next to one another in the longitudinal direction of the lamp.

3. The lamp according to claim 1, wherein all the reflector surfaces are formed by means of the lamp reflector.

4. The lamp according to claim 1, wherein the LED carrier has cooling fins.

5. The lamp according to claim 1, wherein the lamp has a lamp housing with a housing section that is transparent or translucent at least in a light emission direction.

6. The lamp according to claim 1, wherein the LEDs are formed with ignition protection class Ex-d or Ex-m.

7. The lamp according to claim 1, wherein the LEDs are encapsulated relative to the LED carrier by means of a shared LED cover housing and a casting compound.

8. The lamp according to claim 2, wherein each LED group has a respective LED carrier.

9. The lamp according to claim 2, wherein a single LED carrier is provided for both of the LED groups.

10. The lamp according to claim 2, wherein illumination angles of the two LED groups overlap each other.

11. The lamp according to claim 2, wherein the reflector surfaces for each LED group are arranged as a mirror image of the other or asymmetrically with respect to one another.

12. The lamp according to claim 5, wherein the lamp reflector is held in the lamp housing in a detachable manner or forms a firmly attached unit with the lamp housing.

13. The lamp according to claim 5, wherein LEDs of groups of the LEDS form two illumination areas that are essentially separated from each other and that intermix more and more particularly as a distance from the lamp increases.

14. The lamp according to claim 5, wherein the lamp reflector is latched in the lamp housing at lateral end sections.

* * * * *